US005122023A

United States Patent [19]

Mochizuki

[11] Patent Number: 5,122,023

[45] Date of Patent: Jun. 16, 1992

[54] FULLY ARTICULATING RAMP EXTENSION FOR PIPE HANDLING APPARATUS

[75] Inventor: David A. Mochizuki, Anchorage, Ak.

[73] Assignee: Nabors Industries, Inc., Houston, Tex.

[21] Appl. No.: 654,898

[22] Filed: Feb. 13, 1991

[51] Int. Cl.[5] ..... E21B 19/00; E21B 19/20; B66F 11/00

[52] U.S. Cl. ..... 414/22.61; 414/22.52; 414/22.58; 175/85

[58] Field of Search ..... 14/71.7; 414/22.51, 414/22.52, 22.58, 22.61, 22.62, 744, 745.2, 745.9, 744.8, 741; 175/85

[56] References Cited

U.S. PATENT DOCUMENTS

| | | | |
|---|---|---|---|
| 2,643,006 | 6/1953 | King | 214/2.5 |
| 3,053,401 | 9/1962 | Jinkins, Jr. | 214/2.5 |
| 3,706,347 | 12/1972 | Brown | 175/85 |
| 3,916,500 | 11/1975 | Brown | 29/240 |
| 4,062,456 | 12/1977 | Birdwell | 214/1 P |
| 4,082,181 | 4/1978 | Berthold et al. | 198/863 |
| 4,235,566 | 11/1980 | Beeman et al. | 414/22 |
| 4,382,738 | 5/1983 | Frias | 414/22.61 |
| 4,462,749 | 7/1984 | Crocker et al. | 414/745.9 |
| 4,494,899 | 1/1985 | Hoang et al. | 414/22 |
| 4,552,498 | 11/1985 | Dysarz | 414/22.58 |
| 4,595,066 | 6/1986 | Nelmark et al. | 175/85 |
| 4,684,314 | 8/1987 | Luth | 414/745 |

*Primary Examiner*—Ramon S. Britts
*Assistant Examiner*—Nancy P. Connolly
*Attorney, Agent, or Firm*—Arnold, White & Durkee

[57] ABSTRACT

A fully articulating ramp extension provides a quick and efficient means of coupling a drilling module with a pipe shelter.

5 Claims, 5 Drawing Sheets

FULLY ARTICULATING RAMP EXTENSION FOR PIPE HANDLING APPARATUS

INFORMATION REGARDING RELATED APPLICATIONS

This invention is related to the following applications, all of which are subject to assignment to the assignee of the present invention and concurrently filed herewith:

Self-Propelled Drilling Module, Ser. No. 07/655,562.

Method and Apparatus For Controlling the Transfer of Tubular Members Into a Shelter, Ser. No. 07/654,237.

Mobile Drilling Rig For Closely Spaced Well Centers, Ser. No. 07/654,754.

Harness Method and Apparatus, Ser. No. 07/654,898.

BACKGROUND OF THE INVENTION

The present invention relates generally to oilfield drill-pipe handling equipment and, more particularly, to an apparatus and method for quickly and efficiently mating drill-pipe handling equipment housed in a pipe shelter facility with hoisting and other handling equipment mounted in an adjacent, housed portable drilling module.

During oil field drilling and workover operations, it is necessary to make up and break down long strings of tubular goods such as drill pipe. Drill-pipe sections may be stored horizontally in racks in, say, a drill-pipe shelter. The drill pipe must be transferred from the storage racks where the pipe rests horizontally to the drilling module where the pipe will be used in a vertical position to make up a pipe string.

In some locations, especially on the North Slope in Alaska, it is desirable to use highly portable drilling rigs. These rigs are enclosed to protect workers from the hazards of the extremely cold temperatures. One arrangement is to componentize the drilling rig into three basic modules, viz.,: (1) a drilling module that includes a hoist for raising and rotating the pipe string, a rotary table for driving the drill string during drilling operations, and various auxiliary equipment; (2) a mud module for containing and supplying drilling fluids and for providing other services to the drilling setup; and (3) a pipe shelter for storing and delivering drill-pipe sections. In setting up the drilling or workover operation, the drilling module is set in place over the well-bore, and the mud module and the pipe shelter are brought into place adjacent the drilling module. These modules may be self-powered or constructed on trailers which may be towed by oil-field trucks or tractors.

The pipe shelter may have within it a ramp structure to facilitate transfer of pipe sections into the drilling module and to received pipe sections from the drilling module. The drilling module may have within it an extension of the ramp structure to continue to guide the pipe sections as they are moved from the pipe shelter. During setup of the drilling rig, the ramp structure within the pipe shelter must be carefully aligned with the ramp extension in the drilling module to facilitate a smooth path for pipe moving from the ramp in the pipe shelter to the hoisting mechanism in the drilling module. Alignment can be time consuming and tedious because the pipe shelter may be built on a large trailer towed by an oil-field truck, and the truck may have to be moved back and forth a number of times before drilling module and the pipe shelter properly have their respective components satisfactorily aligned. Such an operation can take two to three hours. When workover is required on a number of well in an oilfield, proper alignment of the modules comprising the drilling rig can add substantial time to the job and consequently add significant cost the job. Further, when workover operations are being performed in inclement conditions, such as on the North Slope of Alaska, this alignment operation may add substantial time of exposure to the oilfield workers with a corresponding increase in risk.

Further, as drilling pipe is moved from the pipe shelter into the drilling module, thousands of pounds of pipe are shifted from one structure into the other. The reverse is true as a drill string is removed from the wellbore. This shift of weight is believed to cause a shift in the relative positions of the drilling module and the pipe shelter. This results in loss of alignment or registration between the pipe ramp in the pipe shelter and the ramp extension in the drilling module. More importantly, subsidence can occur in gravel surface cover or due to softening of the permafront in warm weather in arctic areas. Subsidence may result in substantial misalignment of the modules. This may require adjustment of the position of the pipe shelter which again may be time consuming, costly, and hazardous to the oilfield workers. Sufficient misalignment of the pipe ramp and its extension may even result in damage to the drill pipe and other tubular goods such as casing and production tubing which may add substantially to the overall cost and risk of hazard on the job.

It would therefore be advantageous to provide an apparatus and method to align selected components in a drilling module and a pipe shelter without having to move either relative to the other. It would also be advantageous to permit the quick and easy aligning of a pipe ramp in a pipe shelter with a pipe extension in a drilling module. It would further be advantageous to provide a means to maintain proper alignment and registration between a pipe handler and a ramp extension in a drilling module as a pipe string is transferred in a first direction from one structure to the next and then in a second, opposite direction.

SUMMARY OF THE INVENTION

The present invention provides a fully articulating ramp extension. The ramp extension includes a ramp trough slidingly supported on a rotary support table and the hydraulics to adjust the position of the ramp extension and the ramp trough. Under hydraulic power, the ramp extension is rotated in the plane of the support table, moved fore-and-aft along the axis of the ramp trough, and moved laterally in a direction perpendicular to the direction of the ramp trough. Means is also provided to tilt the ramp extension to matingly align with the pipe handling ramp in the pipe shelter.

In use, a drilling module, which may be a self-propelled vehicle, is brought into position over a wellbore. Then, a pipe shelter is brought into approximate position adjacent the drilling module. The pipe shelter may be towed by an oilfield truck and no precise registration between the drilling module and the pipe shelter is required at this point. Next, using the hydraulic controls within the drilling module, an oilfield worker simply adjusts the position of the ramp extension to precisely align the ramp extension with the ramp.

It should be noted that vertical adjustment is available by using jacks on the drilling module and the pipe shelter.

The present invention minimizes the time required to properly mate up a drilling module or portable drilling platform with a pipe shelter. The fully articulating ramp extension provides the further advantage of providing means to quickly and easily maintain the proper registration between the drilling module and the pipe shelter as the pipe load is shifted from one to the other and then back again. This invention also minimizes the time that an oilfield worker is exposed to the elements while the drilling module and the pipe shelter are brought into proper working arrangement relative to one another. Finally, the cost of installing the present invention compared to the overall cost of the entire setup, including the drilling module, the mud module, and the pipe shelter, is insignificant. In a competitive bid situation with all other capabilities being equal, the time and cost savings offered by the present invention offers a significant competitive advantage over systems without the capabilities of the present invention.

These and other advantages of the invention will be readily apparent to those skilled in the art after reading the following detailed description.

DETAILED DESCRIPTION OF A PREFERRED EMBODIMENT

Figure 6:
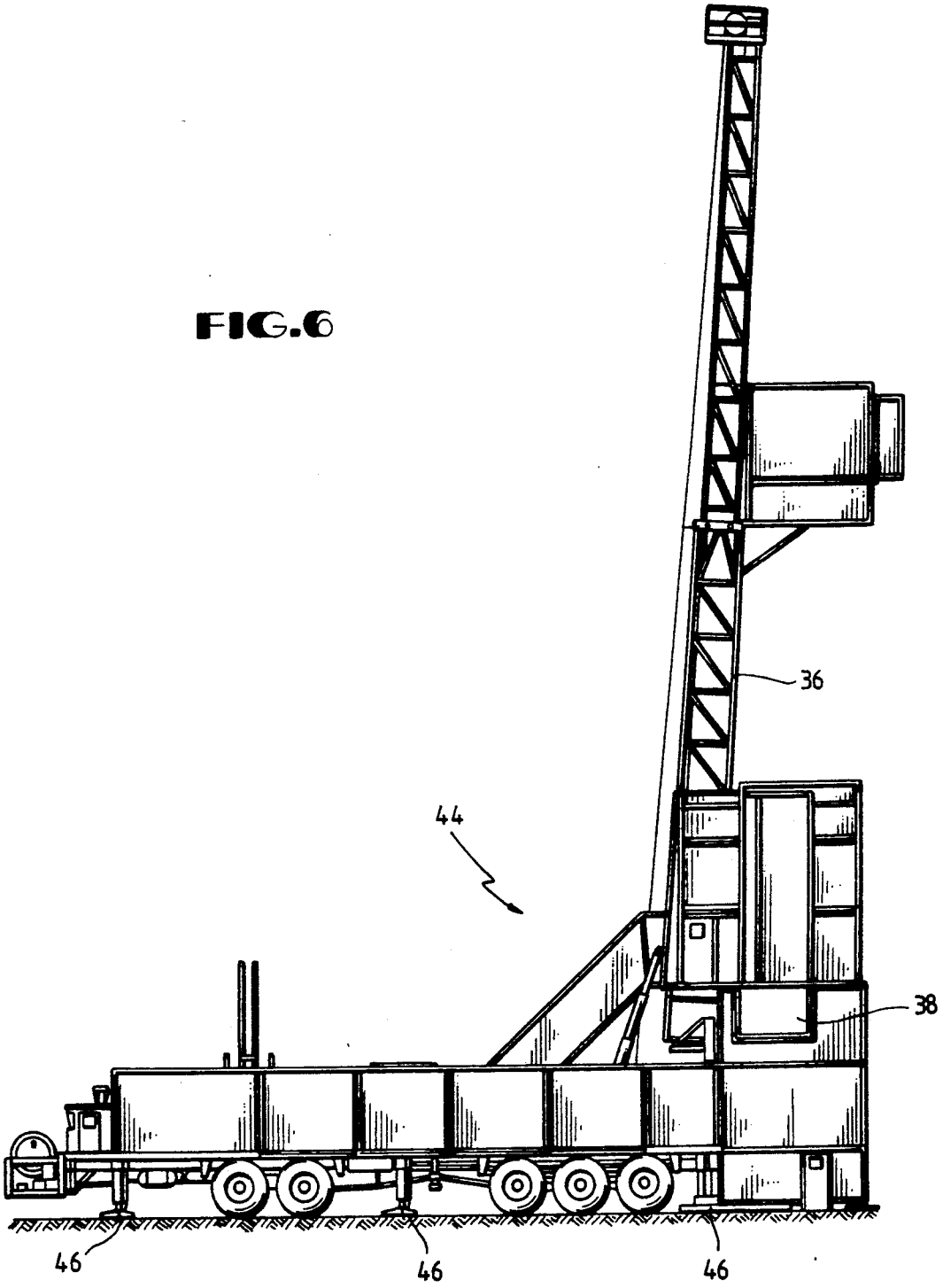
FIG. 6 is an elevation view of a self-propelled drilling module in which the present invention is useful.

FIG. 6 depicts a mobile, self-propelled drilling module 44 that may employ the present invention. The drilling module 44 carries with it a telescoping mast 36. The drilling module 44 also includes a plurality of jacks 46 to provide vertical support during operations and is capable of supporting a full complement of tubular goods such as pipe. The ramp extension 10 (See FIG. 7) of the present invention is located in a pipe transfer access 38 to mate with a pipe shelter 48 to be located immediately adjacent the drilling module 44.

Figure 7:
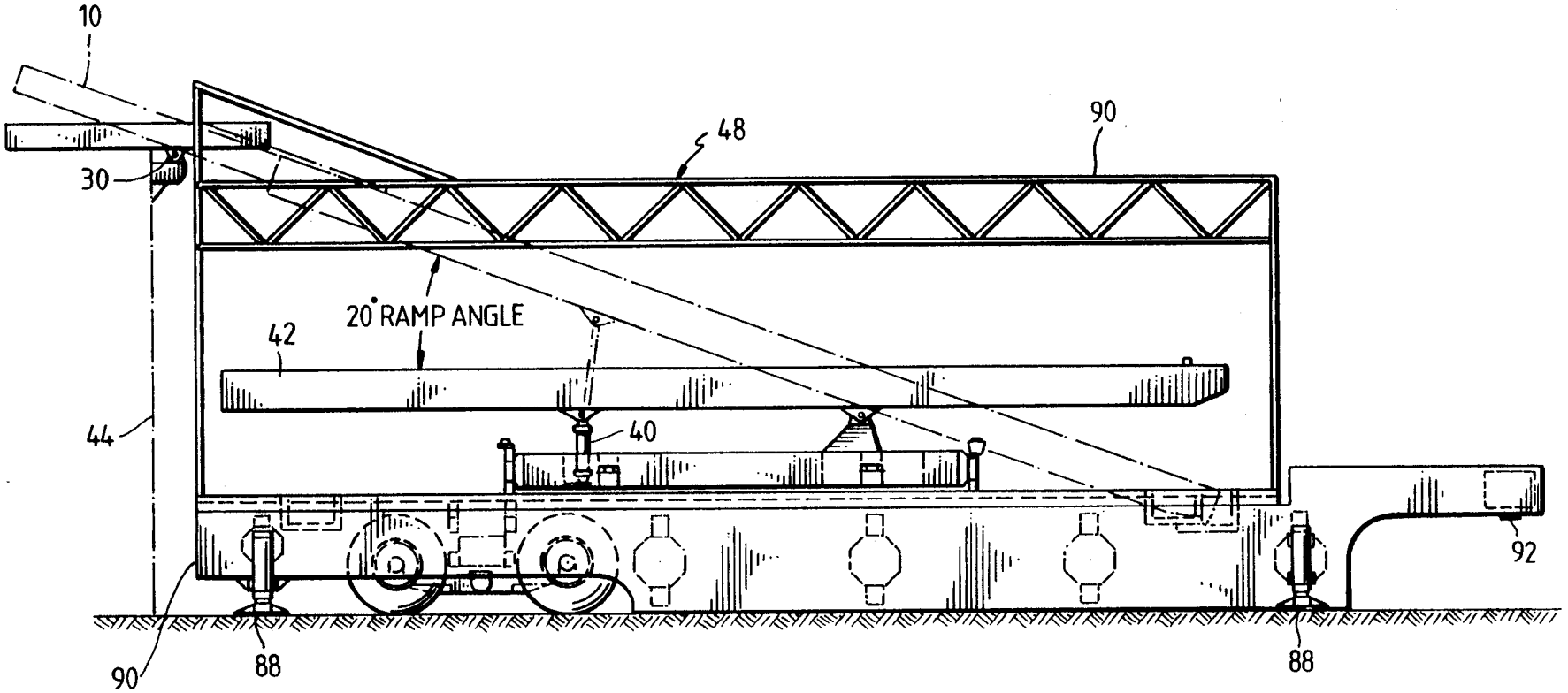
FIG. 7 is an elevation view depicting a pipe-handling ramp in cooperation with the ramp extension of the present invention.

FIG. 7 illustrates a pipe shelter 48 to show how the pipe-handling ramp 42 and the ramp extension 10 mate. A pipe-handling ramp 42 is swung to a horizontal position and a pipe is rolled onto it. Then, a hydraulic ram 40 pivots the pipe-handling ramp 42 to raise one end of the pipe toward the drilling module 44, where the pipe handling ramp 42 engages a ramp extension 10. The ram 40 may pivot the pipe-handling ramp 42 to approximately a 20° angle, for example. Next, a chain-driven end-stop pushes the pipe up the pipe-handling ramp 42 and ultimately onto the ramp extension 10 where it can be grasped by conventional means and delivering or hoisted into the drilling module 44. As a drill string or a pipe string is being broken down, the reverse procedure is used.

The pipe shelter 48 also includes a set of jacks 88, one at each corner of the pipe shelter 48. The trailer may be self powered, but in the preferred embodiment is built on a trailer 90 that includes a trailer hitch 92. Also, as shown in FIG. 7, the pipe shelter includes a ceiling structure 90 that provides support so that the entire structure may be enclosed. In this way, workers preparing pipe for the drilling module are protected from the elements and any chemicals that they use in cleaning and preparing pipe are contained within the shelter, thus protecting the environment.

Figure 1:
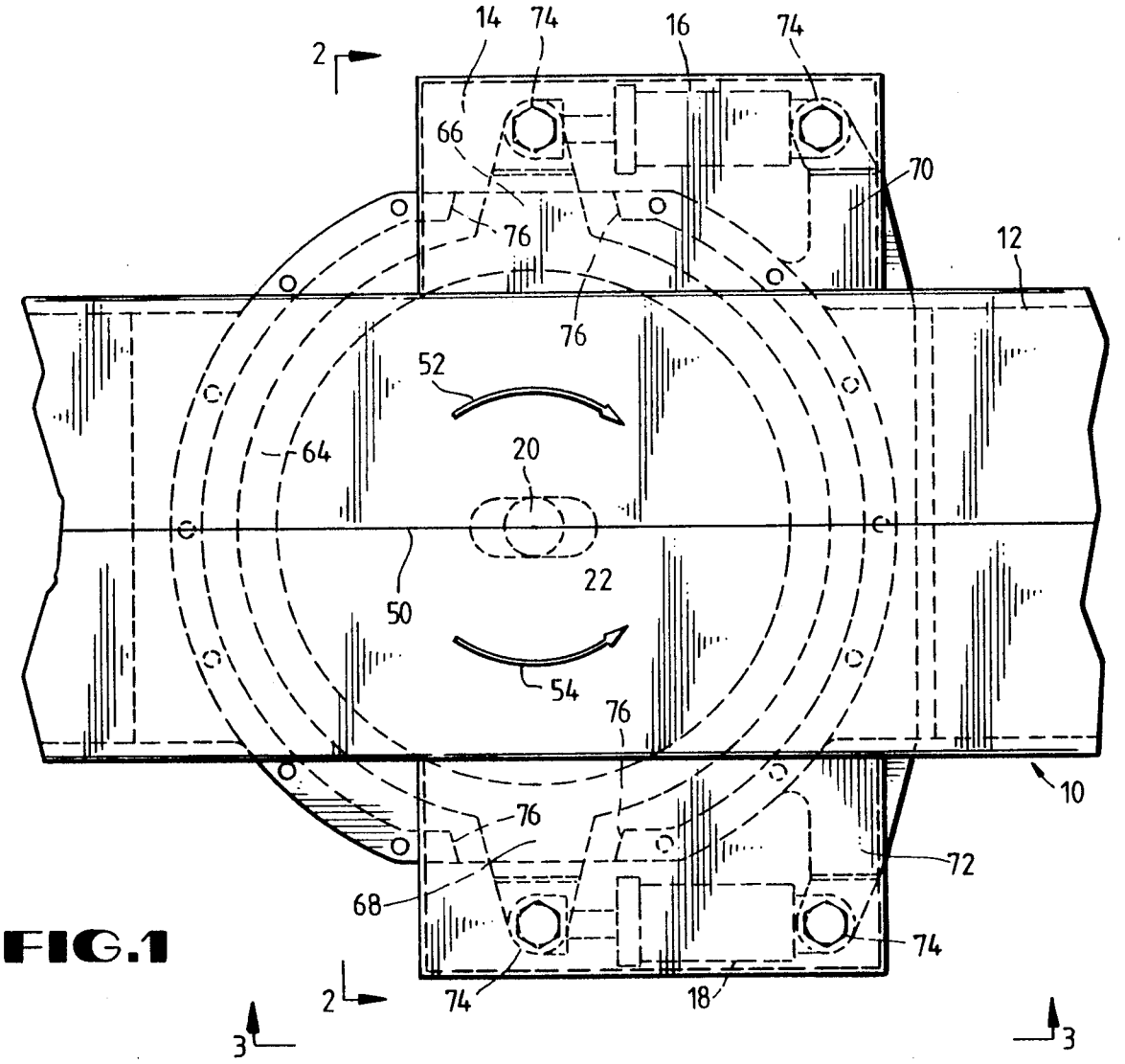
FIG. 1 is an overhead view of the ramp extension of the present invention.

FIG. 1 depicts an overhead view of a ramp extension 10. The ramp extension 10 primarily comprises a ramp trough 12, a rotary support table 14, and a set of support auxiliaries. The support auxiliaries include a pair of hydraulic angle rams 16 and 18. While the hydraulic rams 16 and 18 are preferred, other motive means may be used within the scope and spirit of the present invention so long as they provide adequate force to accomplish the desired motion. The hydraulic angle rams 16 and 18 cooperate to provide the ramp extension with its first and second degrees of freedom of movement. Extending both angle ramp 16 and angle ram 18 moves the ramp trough 12 along its axis 50 guided by a guide post 20 within a keyway 22. In a preferred embodiment, angle rams 16 and 18 provide 3" of travel fore-and-aft along the axis 50 of the ramp trough 12.

Extending the angle ram 16 and contracting the angle ram 18 rotates the ramp trough 12 in the counterclockwise direction 54 in the plane of FIG. 1. Conversely, extending the angle ram 18 and contracting the angle ram 16 rotates the ramp trough in the clockwise direction 52. In a preferred embodiment, the cooperation of the angle rams 16 and 18 provide a full 6° of rotation. This rotation alters the angle at which the ramp extension 10 meets the pipe handling ramp 42 in the pipe shelter 48, hence the use of the term "angle ram".

A swivel element 64 is affixed to and moves in fixed relationship with the ramp trough 12 and includes extensions 66 and 68. A pair of arms 70 and 72 are affixed to the rotary support table 14. Thus, the angle hydraulic rams 16 and 18 couple the ramp trough 12 with the rotary support table 14 at swivel elements 74. Extending one of angle hydraulic rams 16 or 18 and contracting the other creates a jackknife-like action between the extensions 66,68 and the arms 70,72. The amount of rotation of the ramp trough 12 is limited by the length of travel of the angle hydraulic rams 16 and 18 as well as by blocking walls 76.

Figure 2:
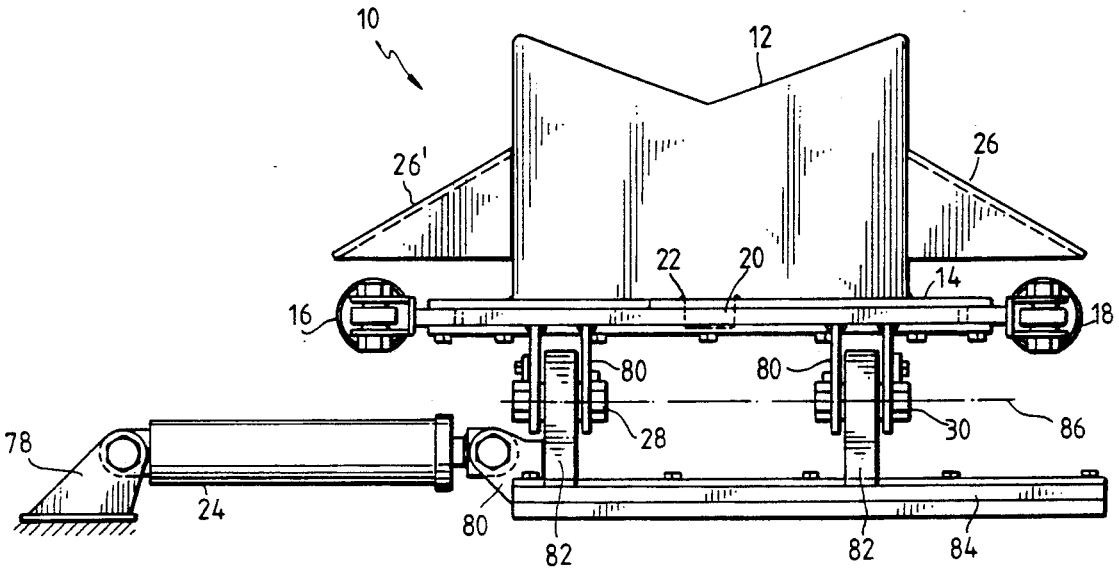
FIG. 2 is an elevation view of the ramp extension.

FIG. 2 depicts an elevation view taken along section line A—A of FIG. 1. The ramp extension 10 includes a ramp trough 12 and rotary support table 14. The ramp trough 12 provides a V-shape cross-section to give lateral support to the pipe and to minimize friction as the pipe slides over the trough 12.

The ramp trough 12 rests in sliding engagement on the rotary support table 14. The auxiliary equipment includes the hydraulic angle rams 16 and 18. The auxiliary equipment further includes a "shift" hydraulic ram 24. Extension or contraction of the shift hydraulic ram 24 provides a lateral movement of the ramp extension. In a preferred embodiment, the shift hydraulic ram provides a full 12" of lateral movement, thus shifting the ramp extension perpendicular to the axis 50 of the ramp trough 12, hence, the use of the term "shift hydraulic ram."

A pair of shields 24 and 26 provide protection to auxiliary equipment such as the hydraulic rams 16 and 18 and hydraulic supply lines (not shown) from falling objects and the footsteps of workers.

The shift hydraulic ram 24 is mounted to the drilling apparatus or drilling module 44 at a pedestal 78. The shift hydraulic ram 24 is mounted to the ramp extension 10 at a pedestal 80. Thus, the shift hydraulic ram 24 couples the drilling module 44 to the ramp extension 10 to provide lateral movement of the ramp extension 10 relative to the drilling module 44.

Figure 3:
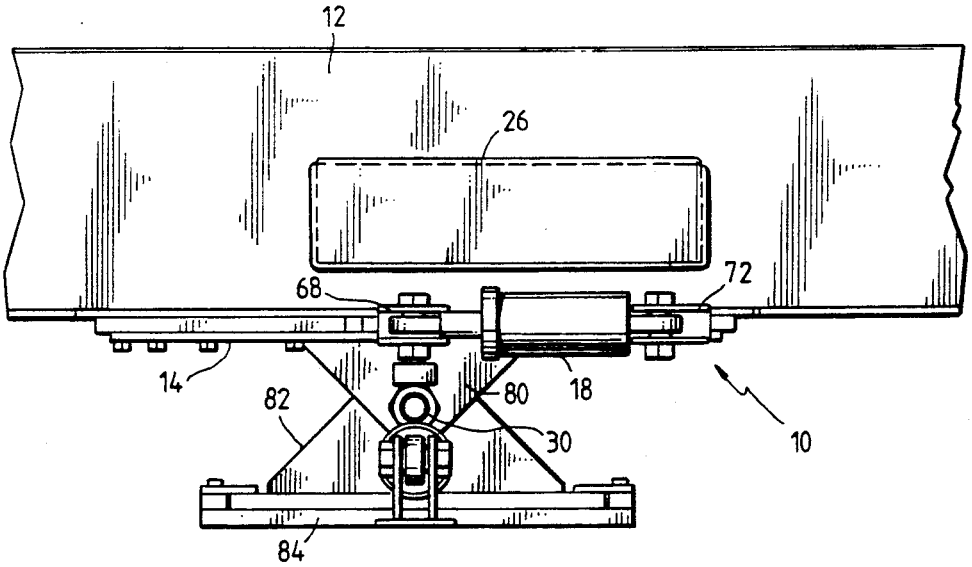
FIG. 3 is another elevation view of the ramp extension.

The ramp extension 10 also includes a pair of tilt swivels 28 and 30 which may be more clearly understood when viewed in FIG. 3. A set of forks 80 rotatingly engage base supports 82 which are an integral part of a base 84. This arrangement permits rotation of the ramp extension 10 about an axis 86 which is parallel to the plane of the base 84.

Figure 4:
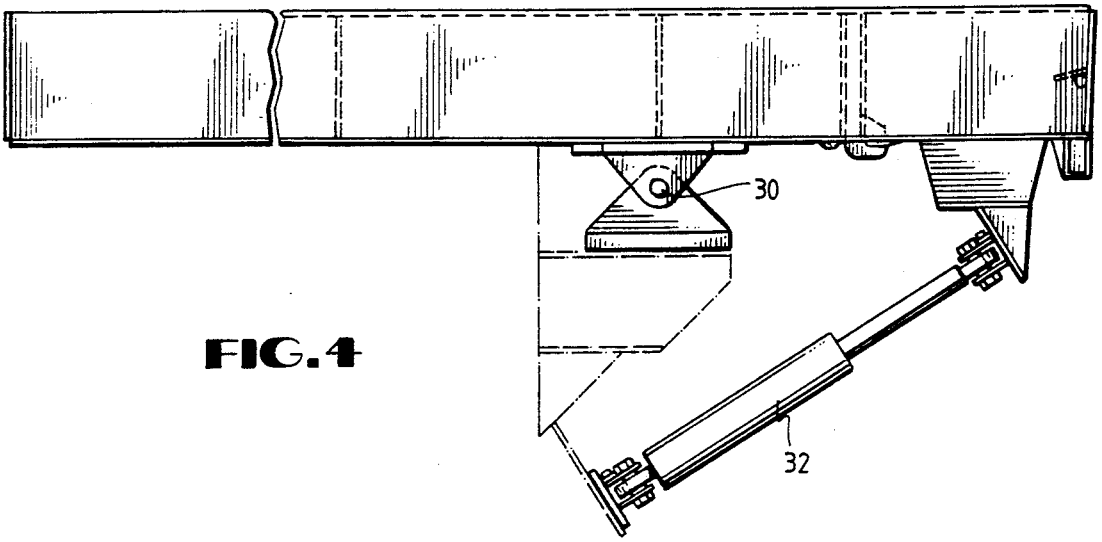
FIG. 4 is a further elevation view of the ramp extension illustrating a tilt ram.

FIG. 3 depicts an elevation view of the ramp extension as viewed along section lines B—B in FIG. 1. In FIG. 3, a tilt ram 32, shown in FIG. 4, has been omitted for clarity. The ram extension 10 includes a hydraulic ram 18, a shield 26, and a tilt swivel 30. The tilt swivel 30 permits the ramp extension 10 to be tilted to align its axis with the axis of a pipe handling ramp 42 in the pipe shelter 48. FIG. 3 also provides a side view of the set of forks 80 coupled to the base supports 82 for rotation about the tilt swivel 30.

Figure 5:
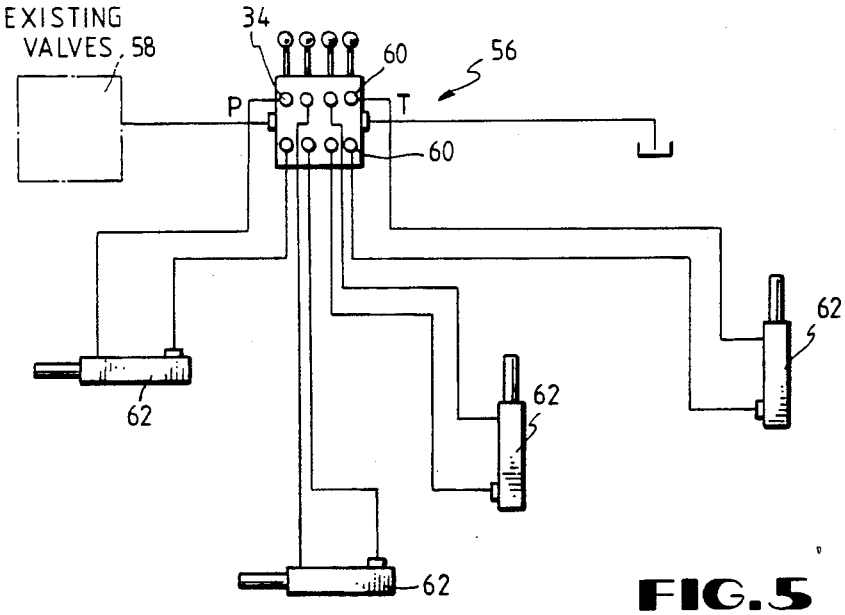
FIG. 5 is a schematic view of the hydraulic controls of the present invention.

FIG. 5 depicts a hydraulic control system 56 for operating the ramp extension auxiliaries. The hydraulic control system 56 may advantageously be supplied by the drilling module's existing hydraulic system 58. The ramp extension's hydraulic control system 56 preferably includes a closed center control valve 34, such as for example a commercial #Va35-AA980-DA7-DA7-DA7-DA7-CY689 control valve. The control valve 34 includes a pair of ports 60 for each of the shift, tilt and angle hydraulic rams 24, 32, and 16,18 respectively. The control system further includes a flow control valve 62, such as for example a HYCON #SRVR-12-1.0/6V control valve for each of the hydraulic rams 24, 32, and 16.18. It has been found that 1 gallon per minute (GPM) flow of hydraulic fluid for each of the shift hydraulic ram 24 and the angle hydraulic rams 16 and 18 and 2 GPM flow for the tilt ram 32 provide adequate speed for expeditious completion of the moving task yet slow enough to provide fine control.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

I claim:

1. A ramp extension for a pipe handling apparatus comprising a. a rotary support table;

b. a ramp trough slidingly and rotatingly supported on the rotary support table; and c. motive means coupling the rotary support table and the pipe handling apparatus to provide means for translating the ramp trough relative to the pipe handling apparatus.

2. The ramp extension of claim 1 wherein the motive means is a hydraulic ram.

3. A ramp extension of a pipe handling apparatus comprising a. a rotary support table;

b. A ramp trough slidingly and rotatingly supported on the rotary support table;

c. a first motive means coupling the rotary support table and the pipe handling apparatus to provide means for translating the ramp trough relative to the pipe handling apparatus;

d. a second motive means coupling the rotary support table and the ramp trough to provide means for rotating and translating the ramp trough relative to the rotary support; and e. a third motive means coupling the rotary support table and the pipe handling apparatus to provide means for tilting the ramp trough and the support table relative to the pipe handling apparatus.

4. The ramp extension of claim 3 wherein each of the first, second, and third motive means is a hydraulic ram.

5. A method of coupling a pipe-handling ramp and ramp extension comprising the steps of:

a. mounting a rotary support table on a drilling module;

b. mounting a ramp trough in rotating and sliding support on the rotary support table, the ramp trough having a axis;

c. bringing a pipe shelter with a tilted pipe-handling ramp in close proximity to the drilling module;

d. tilting the rotary support table and the ramp trough to the same angle of tilt as the pipe-handling ramp;

e. translating the rotary support table and the ramp trough horizontally in a direction perpendicular to the axis of the ramp trough; and f. rotating the ramp trough in the plane of the rotary support table to couple the ramp extension to the pipe-handling ramp.

* * * * *